US005154484A

United States Patent [19]

Aronson

[11] Patent Number: 5,154,484

[45] Date of Patent: Oct. 13, 1992

[54] PORTABLE FOOT AND LEG REST

[76] Inventor: Donald C. Aronson, 124 Hornbeam La., Kinnelon, N.J. 07405

[21] Appl. No.: 689,964

[22] Filed: Apr. 23, 1991

[51] Int. Cl.[5] ..... A47C 16/00

[52] U.S. Cl. ..... 297/438; 297/439

[58] Field of Search ..... 297/438, 439, 16, 19, 297/30, 31, 429, 431, 432, 435, 437

[56] References Cited

U.S. PATENT DOCUMENTS

| | | | |
|---|---|---|---|
| 2,017,433 | 10/1935 | Carrington | 297/439 X |
| 2,353,418 | 7/1944 | Smith | 297/439 X |
| 3,264,033 | 8/1966 | Hansburg | 297/438 |
| 4,228,745 | 10/1980 | Gale | 297/439 X |

FOREIGN PATENT DOCUMENTS

| | | | |
|---|---|---|---|
| 2503665 | 8/1976 | Fed. Rep. of Germany | 297/438 |
| 783026 | 9/1957 | United Kingdom | 297/438 |

*Primary Examiner*—Jose V. Chen

*Attorney, Agent, or Firm*—Carella, Byrne, Bain, Gilfillan, Cecchi & Stewart

[57] ABSTRACT

A portable foot and leg rest includes a frame, one end of which may be temporarily supported by the edge of a chair or couch. The other end of the frame carries legs which are pivotal between a storage position in which they are parallel to the frame and a rotated position in which they are generally perpendicular to and may support the frame in a generally horizontal position. The length of the leg assemblies may be adjusted so that the far end of the frame may be level with, higher than or lower than the end of the frame supported on the chair or couch. A cushion assembly is carried by the frame for selective sliding movement toward and away from the point at which the frame is supported by a chair or couch to accommodate the varying leg length of users.

11 Claims, 1 Drawing Sheet

PORTABLE FOOT AND LEG REST

BACKGROUND OF THE INVENTION

This invention relates to a portable foot and leg rest and more particularly, to a portable foot and leg rest selectively associable with a chair or couch, which rest may be folded or collapsed for transport or storage when not in use, which is horizontally adjustable to accommodate varying leg lengths of users and which is vertically adjustable to accommodate varying chair and couch heights or to elevate the user's feet above or below the chair or couch for therapeutic or comfort reasons.

Portable foot and leg rests are known and are shown in the following U.S. Pat. Nos. 4,345,793; 2,614,613; 2,375,225; 1,979,152; 2,140,310; and 896,982.

An object of the present invention is the provision of a foot and leg rest having the above-noted features, which is more convenient to use and is more esthetically pleasing than those of the prior art.

SUMMARY OF THE INVENTION

With the above and other objects in view, a portable foot and leg rest according to the present invention includes an elongated frame having opposed first and second ends. Facilities at the first frame end selectively temporarily support the frame on a chair or couch. The frame may be a pair of parallel rails held apart by perpendicular struts. The temporary mounting facilities may constitute a shaped depression in each rail which fits over and rests on a chair or couch lip beneath a cushion or a cord between the rails which is placed across the seat of a chair.

Mounted to the second frame end for rotation between a first and second position are a pair of leg assemblies. The leg assemblies have adjustable lengths so that with the first frame end mounted to a couch and the leg assemblies generally perpendicular to the frame, the second frame end may be adjusted to level the frame or to elevate or depress the second end above or below the first end. Preferably, each leg assembly includes parallel leg members which are held together for relative sliding therebetween, such as by a mortise and tenon sliding joint therebetween. In the first position, the leg assemblies are parallel to the frame. In the second position, the assemblies are perpendicular to the frame.

A cushion assembly, parallel to and supported by the frame, is selectively movable between first and second locations on the frame. The cushion assembly, which may include a base with a cushion thereon, is lockable in the first and second locations, as by rods or dowels which support the base and which freely ride in and slide along grooves formed in the frame rails until they fall into contiguous detents. The base may be removably mounted to the rods or dowels, as by clamps selectively attachable to the base and to grip a rod or dowel.

Facilities, such as holes appropriately located in the leg members of each leg assembly one leg member and in both of each assembly and one frame rail and selectively insertable pins, may function to hold the leg assemblies in their first and second rotatable positions and to hold the leg members of each assembly together in a selected length.

DETAILED DESCRIPTION

Figures 1, 2, 3, 4:
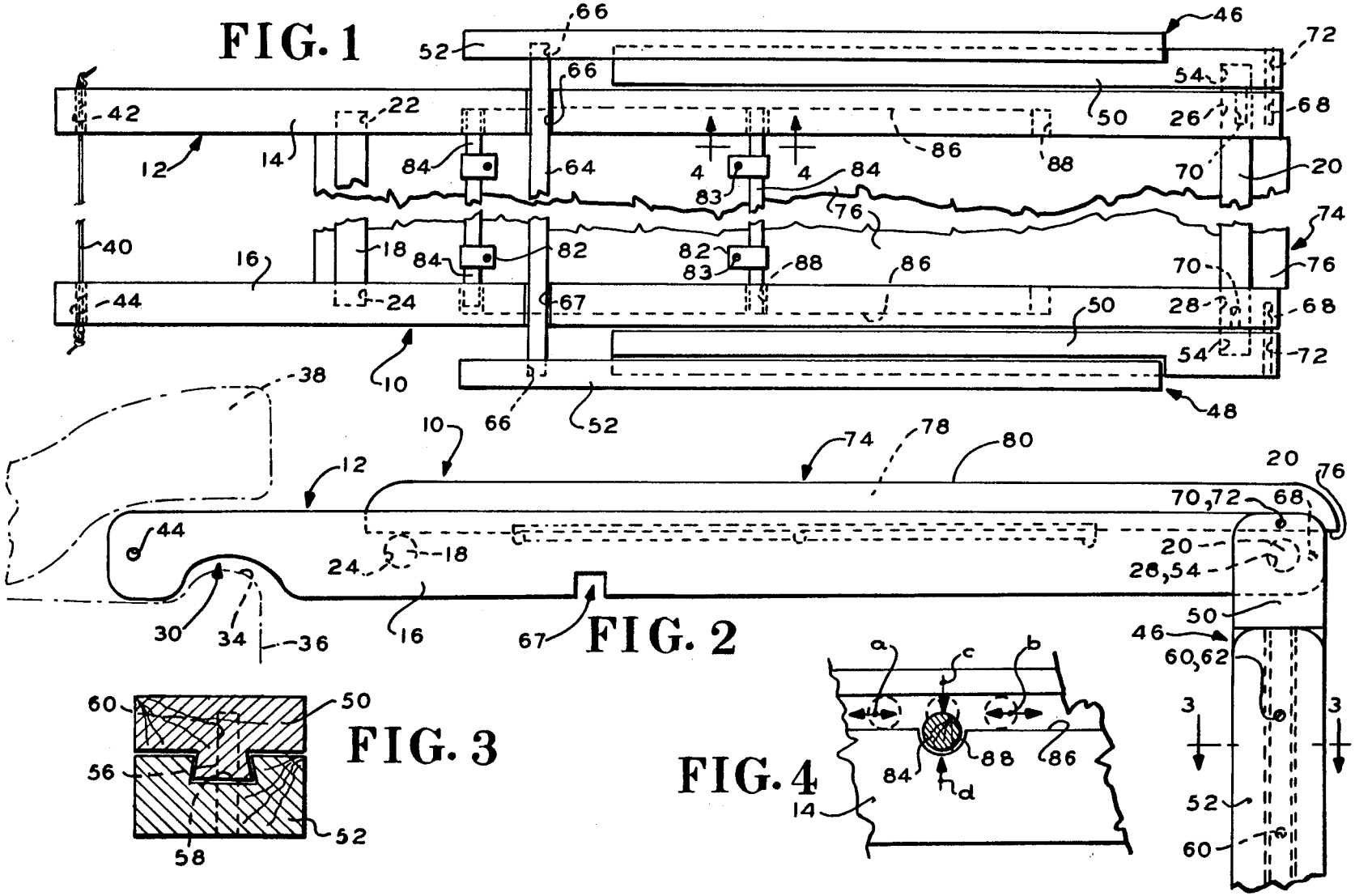
FIG. 1 is a bottom partially broken away view of a foot and leg rest according to the present invention with the rest being folded or collapsed for transport or storage.
FIG. 2 is a side elevation of the rest of FIG. 1 in the unfolded condition with one end resting on a chair.
FIG. 3 is a sectional view taken along line 3—3 in FIG. 2 showing the details of a leg assembly of the rest.
FIG. 4 is a sectional view taken along line 4—4 in FIG. 1.

FIG. 1 shows the bottom of a foot and leg rest 10 according to the present invention. The rest 10 includes a frame 12 which includes a pair of parallel rails 14 and 16 maintained rigidly apart by transverse rods or dowels 18 and 20 which may be held in blind holes 22, 24 and in holes 26, 28 in the rails 14, 16.

As seen in FIG. 2, one end of each rail 14, 16 is formed to have a surface feature, as at 30, which is generally conformable to and supportable on a lip 34 of a chair or couch 36 having a cushion 38. The rail ends may be supported on the seat of a chair (not shown) not having a lip 34 by a cord 40 extending between the rails 14, 16 and knotted at the outside thereof after passing through holes 42, 44 in the rails 14, 16.

The other ends of the rails 14, 16 are supportable by leg assemblies 46, 48. The leg assemblies 46, 48 each include a first leg member 50 and a second leg member 52. The first members 50 are pivotally mounted to the frame 12 by affixing blind holes 54 to the ends of the rod 20 which extends beyond the rails 14, 16, the rod 20 being rotatable in the holes 26, 28 to this end. The second members 52 are held to and are slidable on the first members 50 by any convenient facility, such as the dovetailed mortise 56 and tenon 58 shown in FIG. 3. Relative sliding of the members 50 and 52 adjusts the length of the leg assemblies 46, 48 so that with the rails 14, 16 supported on a chair or couch via the surface feature 30 or the cord 40, and with the leg assemblies 46, 48 rotated to be generally perpendicular to the rails 14, 16, the distal end of the frame 12 is level with, or is a selected distance above or below the chair or couch lip 34 or the chair seat. The first members 50 may have a series of blind holes 60 formed therein. One or both of the second members 52 may have a hole 62 formed therethrough. When the holes 60, 62 are aligned, a pin or dowel (not shown) may be inserted through both thereof to lock the members 50, 52 together in a selected length of the assemblies 46 and 48.

Rigidity between the leg assemblies 46 and 48 is effected by a rod or dowel 64 mounted in blind holes 66 near the distal ends of the members 52. To permit the leg assemblies 46 and 48 to be rotated into parallelism with the rails 14 and 16 for convenient transportation or storage of the rest 10, the rails 14, 16 may be relieved, as at area 66 to receive the rod 64. If it is desired to be able to rotate the assemblies 46, 48 in parallelism with the rails 14, 16 regardless of the length thereof, the relieved area 66 may be extended leftwardly in FIGS. 1 and 2. Holes 68 and 70 in one or both rails 14, 16 and a hole 72 in one or both first leg members 50 are alignable to receive a pin therethrough for locking the assemblies 46 and 48 in their respective folded (FIG. 1) positions or unfolded, support positions (FIG. 2).

A cushion assembly 74 is supported on, and is slidable along the frame 12. The cushion assembly 74 includes a base 76 supporting a cushion 78 and a fabric or similar covering 80 attached to the base 76 beneath the cushion 78. Attached to the underside of the base 76 by, for example, question mark shaped clips 82 and screws 83 are rods or dowels 84 which extend transversely of the rails 14, 16 and are held in longitudinal grooves 86 formed in the rails 14, 16. The rods 84 can slide in the grooves 86 to horizontally adjust the location of the cushion assembly 74 to accommodate the varying leg lengths of users (arrows a and b in FIG. 4). The grooves 86 may include detents 88 into which the rods 84 fall to lock the assembly 74 into a selected location (arrow c in FIG. 4). The rods 84 may be removed from the detents 88 (arrow d in FIG. 4) and thereafter slid in the grooves 86. The base 76 resides between the rails 14, 16. Thus, the distal ends of the rails 14, 16 are maintained rigidly apart by being trapped between the proximal ends of the first leg members 50 and the base 76. Preferably, when the rods 84 are in the detents 88, the base 76 rests on one or both rods 18, 20 depending on the position to which the assembly 74 has been slid.

The cushion thickness and the color of the fabric may be customized, and cleaning of the fabric may be facilitated, by removing the screws 83 and disassociating the cushion assembly 74 from the rods 84, following which the fabric may be detached from the base 76. The color and finish of the rest 10 may be customized with the cushion assembly 74 detached —as by painting or staining—by making its various parts of unfinished wood.

I claim:

1. A foot leg rest, selectively associable with a chair or couch, which comprises:

an elongated frame having opposed first and second ends;

first means at the firs end of the frame for selectively temporarily resting the frame on a chair or couch;

a pair of leg assemblies having selectively adjustable lengths;

second means for rotatably mounting the legs to the second end of the frame for rotation between a first position, whereat the legs and the frame are generally parallel, and a second position, whereat the legs are perpendicular to the frame;

a cushion assembly parallel to and supported by the frame;

third means for permitting selective sliding moment of the cushion assembly between first and second locations on the frame; and fourth means for locking the cushion assembly in the first and the second locations.

2. A foot and leg rest as in claim 1, which further comprises:

fifth means for selectively locking the legs assemblies in the first and the second positions.

3. A foot and leg rest as in claim 1, wherein the leg assemblies each comprise:

a first leg member;

a second leg member generally parallel to the first leg member; and fifth means for holding the leg members together while permitting relative sliding therebetween.

4. A foot and leg rest as in claim 3, which further comprises:

sixth means for locking each first leg member to its second leg member so that the leg assemblies are the same length.

5. A foot and leg rest as in claim 3, wherein:

the fifth means comprises:

a mortise in one leg member and a complementary tenon in the other leg member, the mortise and tenon being dovetailed.

6. A foot and leg rest as in claim 1, wherein:

the frame includes parallel support arms, a first elongated member mounted to the support arms near the first end, and a second elongated member mounted to the support arms near the second end, the cushion assembly being partly supported by at least the second elongated member when it is locked in the first or the second location.

7. A foot and leg rest as in claim 6, wherein:

the second means includes the second elongated member.

8. A foot and leg rest, selectively associable with a chair or couch, which comprises:

an elongated frame having opposed first and second ends;

first means at the first end of the frame for selectively temporarily resting the frame on a chair or couch;

a pair of leg assemblies having selectively adjustable lengths;

second means for rotatably mounting the legs to the second end of the frame for rotation between a first position, whereat the legs and the frame are generally parallel, and a second position, whereat the legs are perpendicular to the frame;

a cushion assembly parallel to and supported by the frame;

third means for permitting selective sliding movement of the cushion assembly between first and second locations on the frame; and said cushion assembly comprising a base;

a cushion on the base; and fourth means for locking the base in the first and the second locations.

9. A foot and leg rest as in claim 8, which further comprises:

fifth means for removably mounting the base to the fourth means.

10. A foot and leg rest as in claim 9, wherein:

the frame includes parallel support arms, and the fourth means includes:

a groove longitudinally formed in each support arm, a support member for the base which extends between, is supported by and is slidable in the grooves, and detents contiguous with the grooves and into which the support member falls when the cushion is in the first and second locations.

11. A foot and leg rest as in claim 10, wherein:

the support member is an elongated rod or dowel, and the fifth means comprises a clamp attachable to the base for gripping the rod or dowel.

* * * * *